US005826301A

United States Patent [19]

Kang et al.

[11] Patent Number: 5,826,301

[45] Date of Patent: Oct. 27, 1998

[54] MULTIPURPOSE AUXILIARY BRUSH FOR A VACUUM CLEANER

[75] Inventors: Sang-Bo Kang; Young-Soon Kim, both of Incheon, Rep. of Korea

[73] Assignee: Daewoo Electronics Co., Ltd., Rep. of Korea

[21] Appl. No.: 763,441

[22] Filed: Dec. 11, 1996

[30] Foreign Application Priority Data

| | | | |
|---|---|---|---|
| Dec. 29, 1995 | [KR] | Rep. of Korea | 1995 65214 |
| Dec. 29, 1995 | [KR] | Rep. of Korea | 1995 65219 |
| Dec. 29, 1995 | [KR] | Rep. of Korea | 1995 65225 |

[51] Int. Cl.[6] ..... A47L 9/02; A47L 9/06

[52] U.S. Cl. ..... 15/416; 15/398; 15/420

[58] Field of Search ..... 15/363, 393, 398, 15/402, 415.1, 416, 420

[56] References Cited

U.S. PATENT DOCUMENTS

| | | | |
|---|---|---|---|
| 4,723,338 | 2/1988 | Otsubo . | |
| 5,452,493 | 9/1995 | Galindo . | |
| 5,502,870 | 4/1996 | Ragner et al. | 15/398 |
| 5,621,946 | 4/1997 | Lee | 15/398 |

FOREIGN PATENT DOCUMENTS

| | | |
|---|---|---|
| 0 679 363 | 11/1995 | European Pat. Off. . |
| 96-13305 | 5/1996 | Rep. of Korea . |
| 1033467 | 6/1966 | United Kingdom . |

*Primary Examiner*—Terrence Till

*Attorney, Agent, or Firm*—Cushman Darby & Cushman Intellectual Property Group of Pillsbury Madison & Sutro, LLP

[57] ABSTRACT

Disclosed is a multipurpose auxiliary brush for complementing a cleaning function of a main brush and for enabling a vacuum cleaner to perform various cleaning jobs, regardless of an object and place to be cleaned. A knife-type brush of the multipurpose auxiliary brush is adapted to clean a recessed surface such as a doorframe, a windowframe, or a recessed place in a room. The multipurpose auxiliary brush is connected to a hose assembly of the vacuum cleaner by inserting the hose assembly through an end of the knife-type brush. A carpet cleaning brush of the multipurpose auxiliary brush is adapted to beat and clean a variety of indented cleaning surfaces such as a sofa, a carpet, or a foot board made of woven goods. The carpet cleaning brush is slideably positioned on the front portion of the knife-type brush. The carpet cleaning brush can protrude in the forward direction from the front portion of the knife-type brush and can be arranged in a fan shape. A haired brush of the multipurpose auxiliary brush is adapted to clean is adapted to clean a recessed cleaning surface on which dust or other foreign substances has piled up such as a doorframe, a windowframe, or a recessed place in a room. The haired brush can be slideably positioned in a selected position on a rear portion of the knife-type brush or the carpet cleaning brush. A plurality of hairs made of a synthetic thread are attached to an end of the haired brush.

30 Claims, 13 Drawing Sheets

MULTIPURPOSE AUXILIARY BRUSH FOR A VACUUM CLEANER

BACKGROUND OF THE INVENTION

1. Field of the Invention

The present invention relates to a multipurpose auxiliary brush for a vacuum cleaner, and more particularly to a multipurpose auxiliary brush for complementing a cleaning function of a main brush in a vacuum cleaner so that a user can perform various cleaning jobs by using the vacuum cleaner, regardless of an object and place to be cleaned.

2. Description of the Prior Art

A variety of vacuum cleaners for easily removing dust or other foreign substances piled up on furniture, a floor, or a carpet in a room have been proposed hitherto. Generally, vacuum cleaners can be classified into canister-type vacuum cleaners and upright-type vacuum cleaners.

A canister-type vacuum cleaner includes a body mounted on wheels and a hose assembly for sucking dust or other foreign substances into the body. A suction generating means such as a suction fan, a motor for driving the suction generating means, and a disposable dust container for filtering dust or other foreign substances from air sucked by the vacuum cleaner, are positioned in the body. A main brush and a suction nozzle are provided at a free end of the hose assembly.

An upright-type vacuum cleaner has a similar constitution to that of the canister-type vacuum cleaner. However, the upright-type vacuum cleaner differs in that it vacuums a surface directly beneath its body, so a hose assembly is not required.

These days, the canister-type vacuum cleaner is more frequently used in the home than the upright-type vacuum.

FIG. 10 illustrates a canister-type vacuum cleaner 100. Vacuum cleaner 100 includes a floor cleaning unit 110, a canister unit 120, and a hose assembly 130 extending between floor cleaning unit 110 and canister unit 120.

Floor cleaning unit 110 includes a main brush (not shown) or a suction nozzle (not shown), and the like. Floor cleaning unit 110 is detachably connected to hose assembly 130. Hose assembly 130 comprises a rigid wand 132 and a flexible hose 134, and is pneumatically connected to a dust collecting compartment (not shown) of canister unit 120 by a suction hose connector 136.

Canister unit 120 mainly includes a hood 122, a cover 124 and a body 126. Hood 122 encloses the dust collecting compartment and is pivotally installed onto body 126 so as to open and close the dust collecting compartment. Further, hood 122 is also provided with a transparent window 128 for notifying the user of the dust collecting state. Cover 124 encloses a motor compartment (not shown) where an electric motor and a suction fan driven by the electric motor are positioned.

When a user wants to clean a flat bottom surface such as a floor by using vacuum cleaner 100 described above, the user slideably moves floor cleaning unit 110, to which a main brush and a suction nozzle are installed, on the surface to be cleaned. However, when the user wants to clean a non-flat surface such as a doorframe, a windowframe, a corner of a room, furniture such as a carpet, etc., or a foot board made of woven goods, a plurality of auxiliary brushes are used instead of floor cleaning unit 110, to which the main brush is installed.

FIGS. 11A to 13B illustrate conventional representative auxiliary brushes.

First, FIGS. 11A and 11B illustrate a knife-type brush 10. Knife-type brush 10 is adapted to clean a recessed surface, on which it is difficult to slideably move floor cleaning unit 110. That is, knife-type brush 10 is adapted to clean a recessed surface such as a doorframe, a windowframe, or a corner of a room.

A first end 12 of knife-type brush 10 is fitted onto rigid wand 132 of hose assembly 130. A second end 14 of knife-type brush 10 has a sharply-slanted tip shape so that second end 14 can easily come into tight contact with the recessed surface. As illustrated in FIG. 11B, knife-type brush 10 includes a through opening 16 formed through an interior of knife-type brush 10 in the longitudinal direction. Through opening 16 is a passageway for air in the atmosphere to flow into vacuum cleaner 100.

FIGS. 12A and 12B illustrate a haired brush 20. Haired brush 20 is adapted to clean a recessed surface on which dust or other foreign substances has piled up such as a doorframe, a windowframe, or a corner of a room. Haired brush 20 includes a brush head 22 and a hollow brush holder 24. A plurality of hairs 26 made of a synthetic thread is attached to brush head 22. A central opening 28 is formed in brush head 22. Central opening 28 is a passageway for air in the atmosphere to flow into vacuum cleaner 100. Brush head 22 is pivotally mounted to rigid wand 132 of hose assembly 130 at certain angle by brush holder 24.

FIGS. 13A and 13B illustrate a carpet cleaning brush 30. Carpet cleaning brush 30 is adapted to beat and clean a variety of indented surfaces such as a sofa, a carpet, or a foot board made of woven goods. A first end 32 of carpet cleaning brush 30 is fitted onto rigid wand 132 of hose assembly 130. A second end 34 of carpet cleaning brush 30 has a polygon shape enlarged to have a large contact surface with the indented surfaces. As shown in FIG. 13B, carpet cleaning brush 30 includes a through opening 36 formed through an interior of carpet cleaning brush 30 in the longitudinal direction. Through opening 36 is a passageway for air in the atmosphere to flow into vacuum cleaner 100.

Hereinbelow, operations of the conventional multipurpose auxiliary brushes having the above described constitution will be briefly described.

Generally, when the user of vacuum cleaner 100 cleans a flat surface such as a floor by using vacuum cleaner 100, the user performs a cleaning work by slideably moving floor cleaning unit 110 on the flat surface.

However, when the user cleans a recessed surface such as a doorframe, a windowframe, or a corner of a room, the user uses knife-type brush 10 as an auxiliary brush. For this purpose, the user of vacuum cleaner 100 separates floor cleaning unit 110 from rigid wand 132 of hose assembly 130 and inserts knife-type brush 10 onto rigid wand 132. Thereafter, the user brings knife-type brush 10 having a sharped tip into contact with the recessed surface and cleans dust or other foreign substances piled up on the recessed surface. Thereby, dust or other foreign substances released from the recessed surface by knife-type brush 10 is sucked into the dust collecting compartment of vacuum cleaner 100.

Meanwhile, when the user cleans a recessed surface on which dust or other foreign substances has piled up such as a doorframe, a windowframe, or a corner of a room, the user uses haired brush 20 as an auxiliary brush. For this purpose, the user of vacuum cleaner 100 separates floor cleaning unit 110 from rigid wand 132 of hose assembly 130 and inserts haired brush 20 onto rigid wand 132. Thereafter, the user brings haired brush 20 into contact with the recessed surface and sweeps dust or other foreign substances off the recessed surface. Thereby, dust or other foreign substances swept from the recessed surface is sucked into the dust collecting compartment of vacuum cleaner 100.

Next, when the user cleans a variety of indented surfaces such as a sofa, a carpet, or a foot board made of woven goods, the user uses carpet cleaning brush 30 as an auxiliary brush. For this purpose, the user of vacuum cleaner 100 separates floor cleaning unit 110 from rigid wand 132 of hose assembly 130 and inserts carpet cleaning brush 30 onto rigid wand 132. Thereafter, the user brings second end 34 of carpet cleaning brush 30 into contact with the indented surfaces and beats the indented surfaces by using second end 34 having a polygon shape. Thereby, dust or other foreign substances piled up on the indented surfaces is released and is sucked into the dust collecting compartment of vacuum cleaner 100.

As described above, when a user cleans a predetermined surface by using multipurpose auxiliary brushes according to the prior art, floor cleaning unit 110 of vacuum cleaner 100 must be removed. Then, a predetermined auxiliary brush adapted to clean an object and place to be cleaned, must be employed, or a multipurpose auxiliary brush must be replaced during its use with another multipurpose auxiliary brush. Accordingly, there are frequent interruptions during a cleaning job, and the cleaning efficiency decreases. Further, multipurpose auxiliary brushes which are separately formed can be lost during their use.

Korea Patent Application Laid-Open Publication No. 96-13305, which was filed on Oct. 31, 1994 by DAEWOO ELECTRONICS CO., LTD., an assignee of the present invention, and published on May 22, 1996, discloses a multipurpose auxiliary brush for a vacuum cleaner. The multipurpose auxiliary brush is made up of a knife-type brush and a haired brush which are integrated into a single body. In the multipurpose auxiliary brush, the haired brush is slideably mounted on the knife-type brush, thereby the haired brush and the knife-type brush are united in a single body. However, the multipurpose auxiliary brush does not include a carpet cleaning brush.

SUMMARY OF THE INVENTION

The present invention is contrived to solve the foregoing problems. It is an object of the present invention to provide a multipurpose auxiliary brush for complementing a cleaning function of a main brush in a vacuum cleaner so that a user can perform various cleaning jobs by using the vacuum cleaner, regardless of an object and place to be cleaned.

In order to achieve the above object, the present invention provides a multipurpose auxiliary brush for a vacuum cleaner, the multipurpose auxiliary brush comprising:

a first auxiliary brush for complementing a cleaning function of a main brush, the first auxiliary brush being adapted to clean a recessed surface and being mounted on a hose assembly of the vacuum cleaner through an end thereof, the first auxiliary brush including a front portion and a rear portion, in which the front portion has a first air flow passage formed through an interior of the front portion, and the second portion has a second air flow passage formed through an interior of the rear portion;

a second auxiliary brush for complementing a cleaning function of a main brush, the second auxiliary brush being adapted to clean an indented surface of predetermined woven goods and being slideably mounted on the front portion, the second auxiliary brush including a first semi-circle shaped portion and a second semi-circle shaped portion which are separated from each other; and a third auxiliary brush for complementing a cleaning function of a main brush, the third auxiliary brush being adapted to clean a recessed surface and being slideably selectively mounted on the first auxiliary brush or the second auxiliary brush, the second auxiliary brush including a third semi-circle shaped portion, in which the third semi-circle shaped portion has a plurality of hairs attached to an end thereof.

According to a preferred first embodiment of the present invention, the front portion includes a plurality of first protrusions for slideably supporting the second auxiliary brush. The first protrusions are formed on an outer periphery of the front portion and extend in the longitudinal direction of the front portion. The first guide grooves for slideably guiding the second auxiliary brush are formed on upper portions of the first protrusions. The first locking grooves for stopping the second auxiliary brush from moving along the first guide grooves are formed on front ends of the first guide grooves.

A recess for receiving a part of the second auxiliary brush is formed in the rear portion.

The rear portion includes a second locking groove for fixing the third auxiliary brush on the rear portion when the third auxiliary brush is positioned on the rear portion. The second locking groove is formed on an outer periphery of the rear portion.

A diameter of the rear portion is larger than a diameter of the front portion. A first shoulder is formed between the front portion and the rear portion.

The first air flow passage is pneumatically connected with the second air flow passage. A diameter of the second air flow passage is larger than a diameter of the first air flow passage.

The first semi-circle shaped portion includes a third locking groove for fixing the third auxiliary brush on the second auxiliary brush when the third auxiliary brush is positioned on the second auxiliary brush. The third locking groove is formed on an outer periphery of the first semi-circle shaped portion.

The first semi-circle shaped portion includes a plurality of first prominences and depressions formed at an inner lower portion of the first semi-circle shaped portion, and includes a plurality of first taper portions formed at an end of the first semi-circle shaped portion. The second semi-circle shaped portion includes a plurality of second prominences and depressions formed at an inner lower portion of the second semi-circle shaped portion, and includes a plurality of second taper portions formed at an end of the second semi-circle shaped portion.

A first cut-off portion is formed between the first taper portions, and a second cut-off portion is formed between the second taper portions. A second shoulder is formed at a lower portion of the first taper portion, and a third shoulder is formed at a lower portion of the second taper portion.

The first semi-circle shaped portion includes a plurality of second protrusions formed on an inner periphery of the first semi-circle shaped portion and extending in the longitudinal direction of the first semi-circle shaped portion, and includes a plurality of second locking protrusions formed on an inner periphery of the first taper portion and protruding in the inward direction. The second semi-circle shaped portion includes a plurality of third protrusions formed on an inner periphery of the second semi-circle shaped portion and extending in the longitudinal direction of the second semi-circle shaped portion, and includes a plurality of third locking protrusions formed on an inner periphery of the second taper portion and protruding in the inward direction.

The third auxiliary brush includes a first locking protrusion formed on an inner periphery of the third auxiliary brush and extending in the inward direction. The first locking protrusion is inserted into the second locking groove when the third auxiliary brush is slideably positioned on the first auxiliary brush. The first locking protrusion is inserted into the third locking groove when the third auxiliary brush is slideably positioned on the second auxiliary brush.

The third auxiliary brush has a cylindrical-shape, and one side of the third auxiliary brush is cut off.

According to a preferred second embodiment of the present invention, the third auxiliary brush includes a first segment and a second segment which are separated from each other. An end of the first segment and an end of the second segment are cut off at a predetermined first angle with reference to an outer periphery of the third auxiliary brush.

The first segment includes a concave third locking protrusion formed at an end of the first segment and protruding in the inward direction, and the second segment includes a convex fourth locking protrusion formed at an end of the second segment and protruding in the inward direction. The third locking protrusion and the fourth locking protrusion are inserted into the second locking groove when the third auxiliary brush is slideably positioned on the first auxiliary brush. The third locking protrusion and the fourth locking protrusion are inserted into the third locking groove when the third auxiliary brush is slideably positioned on the second auxiliary brush.

The first segment includes an engaging groove formed at a center of the first segment, and the second segment includes an engaging protrusion formed at a lower center of the second segment. The engaging protrusion is inserted into the engaging groove when the third auxiliary brush is slideably positioned in a selected position on the first auxiliary brush or the second auxiliary brush.

According to a preferred third embodiment of the present invention, the front portion and the rear portion are separately formed, an end of the front portion which is capable of being inserted into the rear portion is cut off at a predetermined second angle, and a third cut-off portion is formed at a front end of the rear portion. The front portion includes a fifth locking protrusion formed on an outer periphery of the end of the front portion and protruding in the outward direction, and the rear portion includes a second guide slot formed along a horizontal line on which the fifth locking protrusion is formed, a third guide slot formed in a predetermined third angle to the second guide slot, and a connecting groove for connecting the second guide slot with the third guide slot.

As described above, according to the preferred first embodiment of the present invention, it is possible to obtain a multipurpose auxiliary brush which is made up of a first auxiliary brush, a second auxiliary brush and a third auxiliary brush. Accordingly, a user can perform various cleaning jobs by using a vacuum cleaner having the multipurpose auxiliary brush according to the present invention, regardless of an object and place to be cleaned.

Further, according to the preferred second embodiment of the present invention, it is possible to obtain a multipurpose auxiliary brush having an improved third auxiliary brush in comparison to the third auxiliary brush according to the preferred first embodiment of the present invention. Accordingly, it is possible to easily clean an interior of an opening a stage.

Further, according to the preferred third embodiment of the present invention, it is possible to obtain a multipurpose auxiliary brush having an improved first auxiliary brush in comparison to the first auxiliary brush according to the preferred first embodiment of the present invention. Accordingly, a working realm of a vacuum cleaner provided with the multipurpose auxiliary brush according to the present invention is enlarged, and the cleaning efficiency of the vacuum cleaner is enhanced. In addition, the vacuum cleaner offers convenience to the user.

BRIEF DESCRIPTION OF THE DRAWINGS

The above object and other characteristics and advantages of the present invention will become more apparent by describing in detail a preferred embodiment thereof with reference to the attached drawings, in which.

DETAILED DESCRIPTION OF THE INVENTION

Hereinafter, the preferred embodiment of the present invention will be explained in more detail with reference to the accompanying drawings.

FIGS. 1 to 7 illustrate a multipurpose auxiliary brush 200 according to a preferred first embodiment of the present invention.

Figure 1:
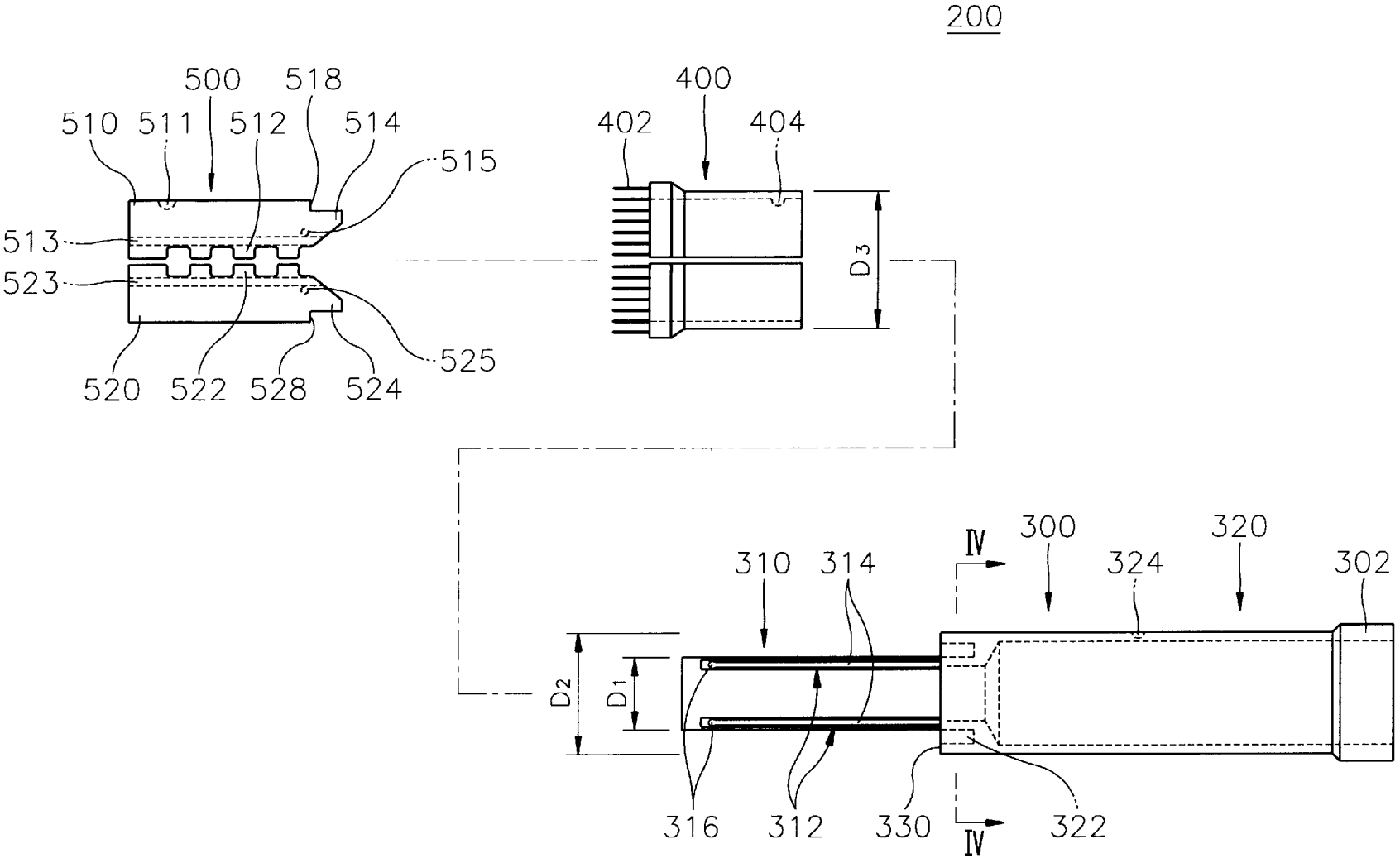
FIG. 1 is an exploded perspective view of a multipurpose auxiliary brush according to a preferred first embodiment of the present invention.

First, referring to FIG. 1, multipurpose auxiliary brush 200 includes a knife-type brush 300, a haired brush 400 and a carpet cleaning brush 500.

Figure 10:
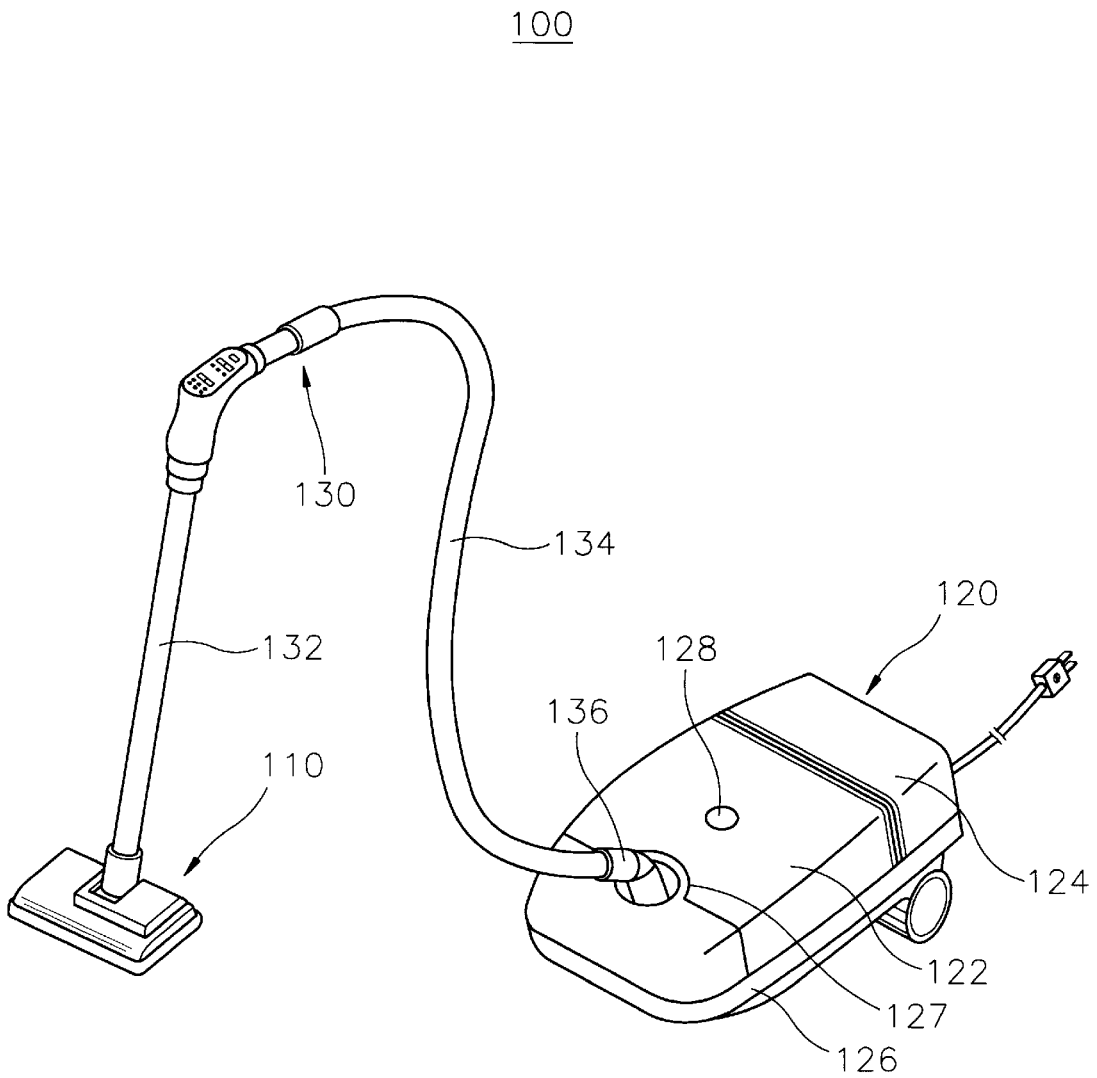
FIG. 10 (PRIOR ART)
FIG. 10 is a perspective view of a canister-type vacuum cleaner according to the prior art.
Figure 11A:
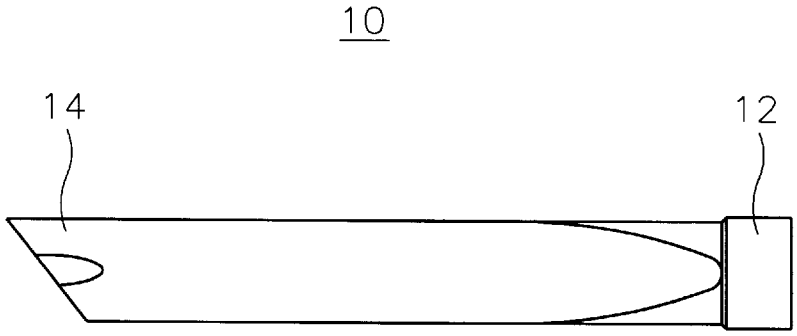
FIG. 11A (PRIOR ART)
FIG. 11A is a perspective view of a knife-type brush according to the prior art.
Figure 11B:
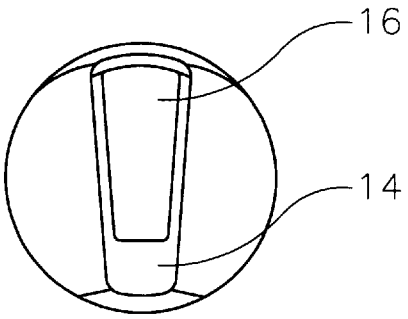
FIG. 11B (PRIOR ART)
FIG. 11B is a left side elevational view of the knife-type brush illustrated in FIG. 11A.
Figure 12A:
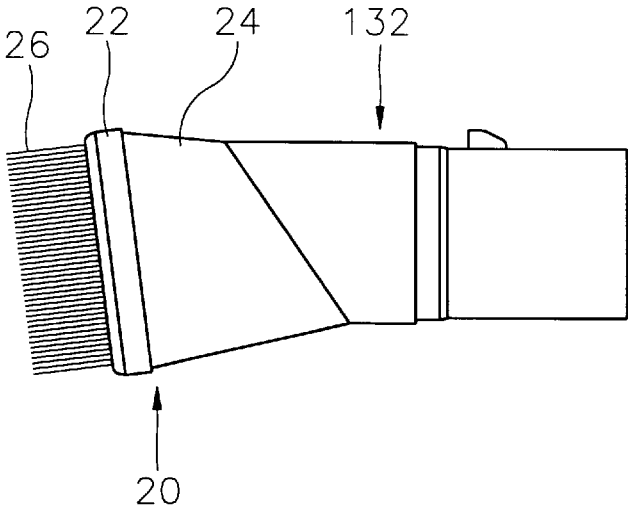
FIG. 12A (PRIOR ART)
FIG. 12A is a perspective view of a haired brush according to the prior art.
Figure 12B:
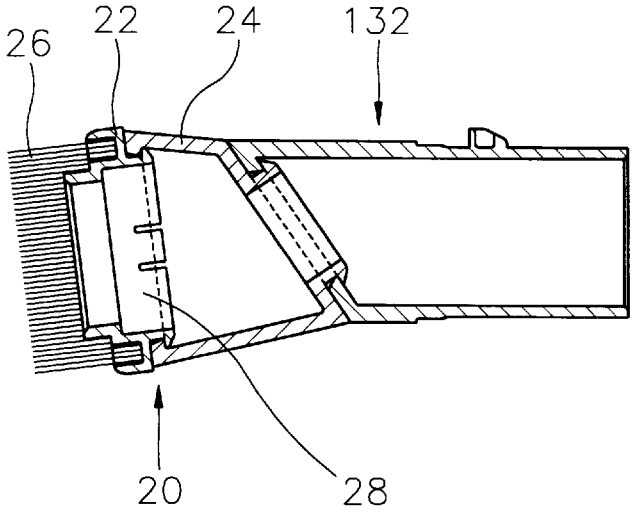
FIG. 12B (PRIOR ART)
FIG. 12B is a longitudinal sectional view of the haired brush illustrated in FIG. 12A.
Figure 13A:
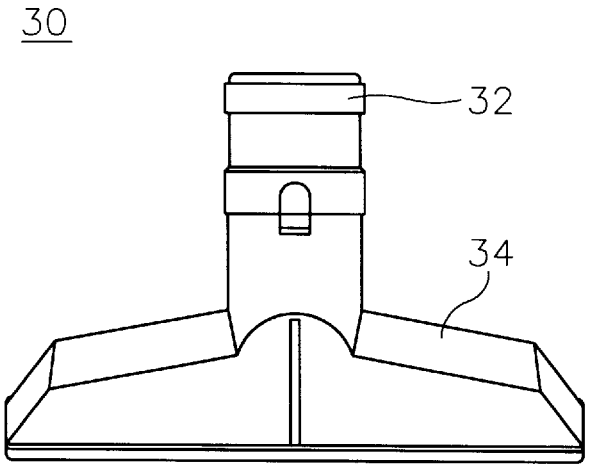
FIG. 13A (PRIOR ART)
FIG. 13A is a perspective view of a carpet cleaning brush according to the prior art.
Figure 13B:
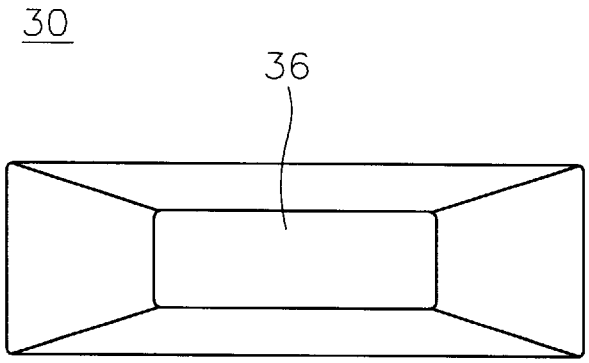
FIG. 13B (PRIOR ART)
FIG. 13B is a bottom plan view of the carpet cleaning brush illustrated in FIG. 13A.

Knife-type brush 300 is adapted to clean a recessed surface on which it is difficult to slideably move floor cleaning unit 110 (referred to FIG. 10). That is, knife-type brush 300 is adapted to clean a recessed surface such as a doorframe, a windowframe, or a corner of a room. An end 302 of knife-type brush 300 is fitted onto rigid wand 132 (referred to FIG. 10) of hose assembly 130. Knife-type brush 300 includes a front portion 310 and a rear portion 320. Front portion 310 has a predetermined diameter $D_1$. A diameter $D_2$ of rear portion 320 is larger than the diameter $D_1$ of front portion 310. Thereby, a first shoulder 330 is formed between front portion 310 and rear portion 320.

Figure 4A:
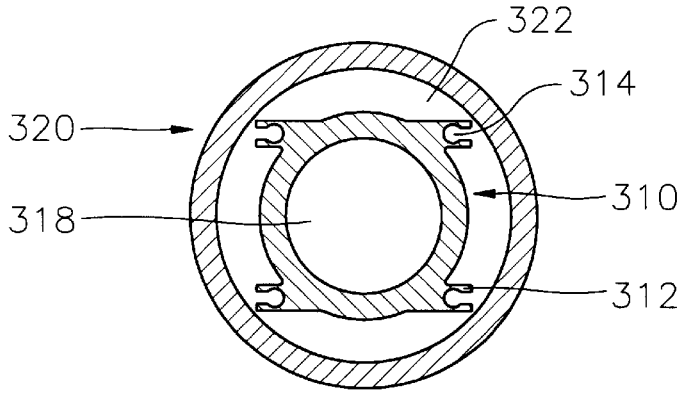
FIG. 4A is a cross-sectional view taken along line IV—IV shown in FIG. 1.

As shown in FIGS. 1 and 4, a plurality of first protrusions 312, for slideably supporting carpet cleaning brush 500, are formed at an outer periphery of front portion 310. First protrusions 312 extend in the longitudinal direction of knife-type brush 300. First guide slots 314, for slideably guiding carpet cleaning brush 300, are formed at upper portions of first protrusions 312. First locking grooves 316 are formed at front ends of first guide slots 314, which are located at the free ends of front portion 310. Front portion 310 includes a first air flow passageway 318 formed through an interior of front portion 310.

A circular recess 322 for receiving a part of carpet cleaning brush 500, is formed in a front end of rear portion 320. In FIG. 1, as indicated by the dotted line, recess 322 extends between first shoulder 330 and a predetermined place in rear portion 320. Front portion 310 of knife-type brush 300 extends to a distal end of recess 322 beyond first shoulder 330.

A second locking groove 324 is formed at an outer periphery of rear portion 320. As shown in FIG. 5B, rear portion 320 includes a second air flow passageway 328 formed through an interior of rear portion 320. Preferably, a diameter of second air flow passageway 328 is larger than a diameter of first air flow passageway 318.

Haired brush 400 is adapted to clean a recessed surface on which dust or other foreign substances has piled up, such as a doorframe, a windowframe, or a corner of a room. Haired brush 400 is slideably mounted on knife-type brush 300. For this purpose, haired brush 400 has a diameter $D_3$ which is larger than a diameter $D_2$ of rear portion 320.

A plurality of hairs 402 made of a synthetic thread are attached to an end of haired brush 400. In FIG. 1, as indicated by the dotted line, a first locking protrusion 404 is formed on an inner periphery of haired brush 400. When haired brush 400 is mounted on rear portion 320 of knife-type brush 300, first locking protrusion 404 is inserted into a second locking groove 324 formed at an outer periphery of rear portion 320. Thereby, haired brush 400 is fixed on rear portion 320 of knife-type brush 300.

As shown in FIGS. 1 and 5B, haired brush 400 has a cylindrical shape, and one side of haired brush 400 is cut off from the other side of hair brush 400 in order to move haired brush 400 from rear portion 320 of knife-type brush 300 to front portion 310. That is, since one side of haired brush 400 is cut off, a user of vacuum cleaner 100 (referred to FIG. 10) can manually enlarge the diameter $D_3$ of haired brush 400. Thereby, first locking protrusion 404 formed in the inner periphery of haired brush 400 is easily released from second locking groove 324 formed on the outer periphery of rear portion 320.

Carpet cleaning brush 500 is adapted to beat and clean a variety of indented surfaces such as a sofa, a carpet or a foot board made of woven goods. Carpet cleaning brush 500 includes a first semi-circle shaped portion 510 and a second semi-circle shaped portion 520 which are separated from each other. Third locking groove 511, for fixing haired brush 400, is formed on an outer periphery of first semi-circle shaped portion 510. When haired brush 400 is slideably positioned on carpet cleaning brush 500, third locking groove 511 receives first locking protrusion 404 of haired brush 400.

Figure 3:
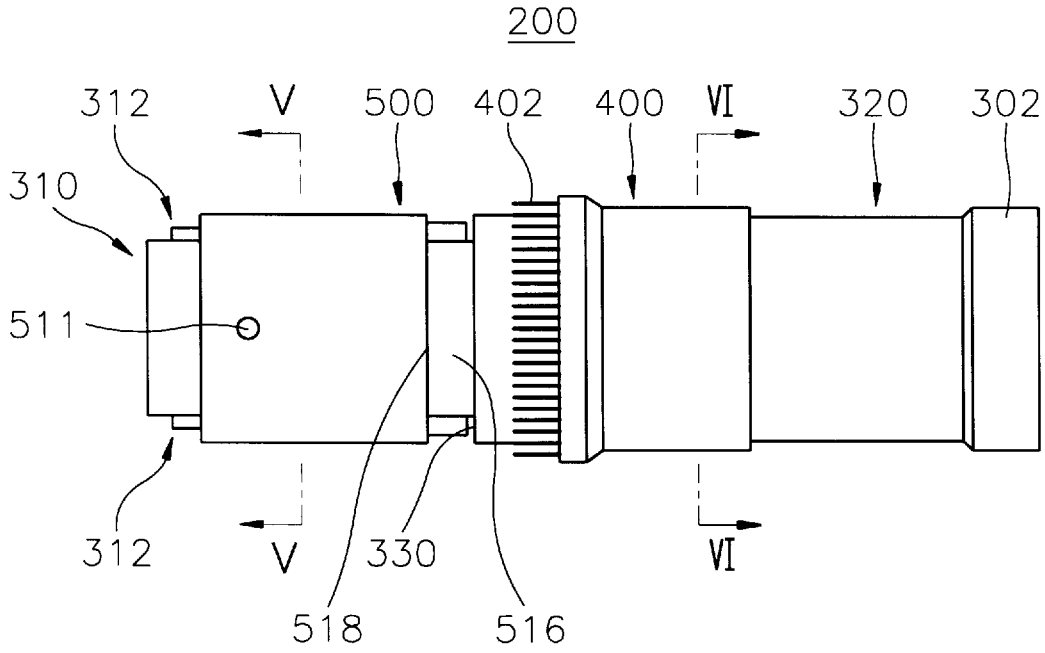
FIG. 3 is a plan view of the multipurpose auxiliary brush illustrated in FIG. 2.

A plurality of first prominences and depressions 512 are formed at an inner lower portion of first semi-circle shaped portion 510. First prominences and depressions 512 can easily be brought into contact with the carpet or the foot board made of woven goods. A plurality of first tapered portions 514 are formed at an end of first semi-circle shaped portion 510. As shown in FIG. 3, a first cut-off portion 516 is formed between first tapered portions 514. When a user cleans the indented surfaces by using carpet cleaning brush 500 (referred to FIG. 7), first cut-off portion 516 makes it possible to vertically deploy first semi-circle shaped portion 510 of carpet cleaning brush 500 without interference by front portion 310 of knife-type brush 300.

When carpet cleaning brush 500 is not being used, first tapered portion 514 moves into recess 322 formed in rear portion 320 of knife-type brush 300. A second shoulder 518 is formed at a lower portion of first tapered portion 514 adjacent to first cut-off portion 516. When carpet cleaning brush 500 moves into recess 322, second shoulder 518 prevents carpet cleaning brush 500 from being pushed into recess 322 beyond a formative position of second shoulder 518. Further, when the user performs cleaning jobs by using carpet cleaning brush 500, second shoulder 518 prevents first semi-circle shaped portion 510 deployed in the vertical direction from folding in the inward direction.

A plurality of second prominences and depressions 522 are formed at an inner lower portion of second semi-circle shaped portion 520. In the same manner as first prominences and depressions 512, second prominences and depressions 522 can easily be brought into contact with the carpet or the foot board made of woven goods. A plurality of second tapered portions 524 are formed at an end of second semi-circle shaped portion 520. A second cut-off portion 526 is formed between second tapered portions 524. Second cut-off portion 526 is formed symmetrically to first cut-off portion 516 of first semi-circle shaped portion 510. When the user cleans the indented surface by using carpet cleaning brush 500, second cut-off portion 526 makes it possible to deploy second semi-circle shaped portion 520 of carpet cleaning brush 500 without interference by front portion 310 of knife-type brush 300.

Second tapered portion 524 is formed symmetrically to first tapered portion 514 of first semi-circle shaped portion 510. In the same manner as first tapered portion 514, when carpet cleaning brush 500 is not being used, second tapered portion 524 moves into recess 322. Third shoulder 528 is formed at the lower portion of second tapered portion 524. Third shoulder 528 is formed symmetrically to second shoulder 518 of first semi-circle shaped portion 510, and performs the same function as second shoulder 518.

Figure 4B:
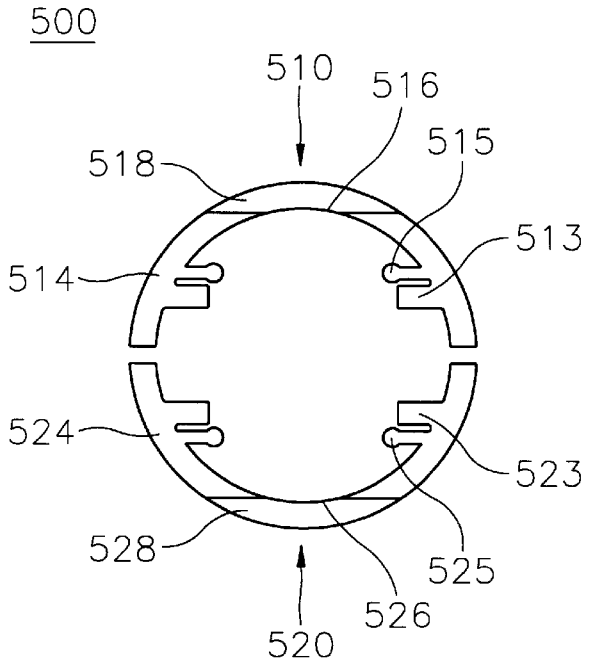
FIG. 4B is a right side elevational view of a carpet cleaning brush illustrated in FIG. 1.

As best shown in FIG. 4B, first semi-circle shaped portion 510 and second semi-circle shaped portion 520 of carpet cleaning brush 500 include a plurality of second protrusions 513 and a plurality of third protrusions 523, respectively. Second protrusions 513 and third protrusions 523 extend in the inward direction along the longitudinal direction of first semi-circle shaped portion 510 and second semi-circle shaped portion 520, respectively.

Figure 5A:
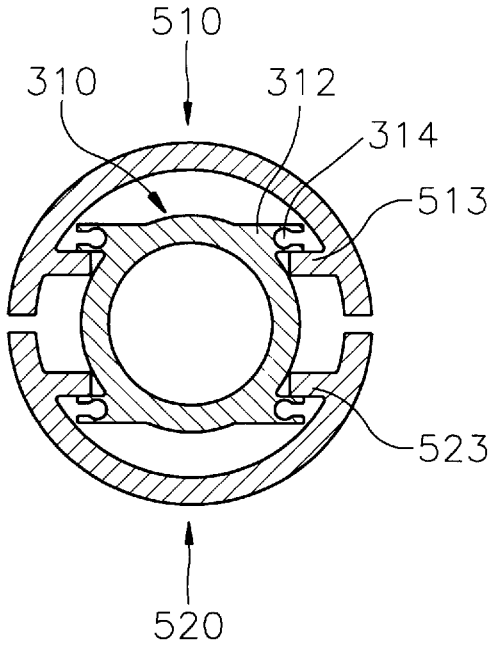
FIG. 5A is a cross-sectional view taken along line V—V shown in FIG. 3.
Figure 5B:
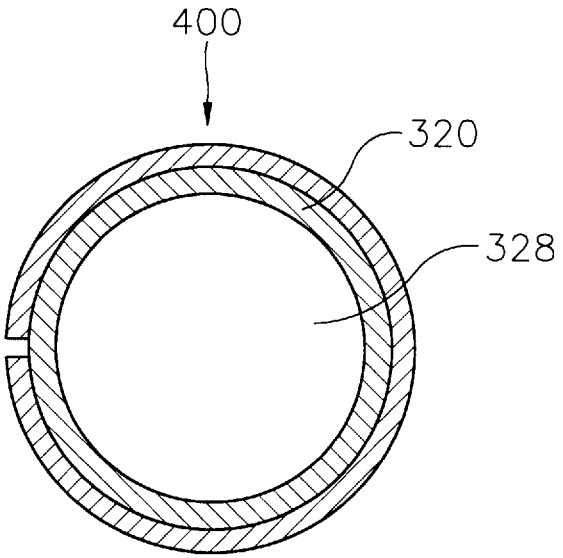
FIG. 5B is a cross-sectional view taken along line VI—VI shown in FIG. 3.

As shown in FIG. 5A, when carpet cleaning brush 500 is slideably positioned on front portion 310 of knife-type brush 300, second protrusion 513 and third protrusion 523 engage with first protrusion 312 formed on the outer periphery of front portion 310. Thereby, first semi-circle shaped portion 510 and second semi-circle shaped portion 520 of carpet cleaning brush 500 are supported and are not released from front portion 310 of knife-type brush 300.

Referring to FIG. 4B again, first semi-circle shaped portion 510 and second semi-circle shaped portion 520 include a plurality of second locking protrusions 515 and a plurality of third locking protrusions 525, respectively. Second locking protrusions 515 protrude in radially inward from an interior of first tapered portions 514 at predetermined positions between second protrusions 513. In the same manner as second locking protrusions 515, third locking protrusions 525 protrude in radially inward from an interior of second tapered portions 524 at predetermined positions between third protrusions 523. When carpet cleaning brush 500 slideably moves along front portion 310 of knife-type brush 300, second locking protrusion 515 and third locking protrusion 525 slideably move along first guide slot 314 formed on first protrusion 312.

The practical application mode of multipurpose auxiliary brush 200 having the above described constitution according to a preferred first embodiment of the present invention, will be described.

First, when a user of vacuum cleaner 100 cleans a flat bottom surface such as a floor by using vacuum cleaner 100, the user slideably moves floor cleaning unit 110, to which a main brush and a suction nozzle are installed, on a surface to be cleaned and performs a cleaning job.

However, when the user cleans a non-flat surface such as a doorframe, a windowframe, a corner of a room, a sofa, a carpet, or a foot board made of woven goods, multipurpose auxiliary brush 200 according to the preferred first embodiment of the present invention is employed instead of floor cleaning unit 110, to which the main brush is installed. For this purpose, floor cleaning unit 110 is removed from rigid wand 132 of hose assembly 130, and then end 302 of knife-type brush 300 is fitted onto rigid wand 132 of hose assembly 130. Thereby, multipurpose auxiliary brush 200 is mounted on rigid wand 132.

When the user of vacuum cleaner 100 cleans a recessed surface such as a doorframe, a windowframe, or a corner of a room by using multipurpose auxiliary brush 200, knife-type brush 300 is mainly employed. Because, knife-type brush 300 has a contact area with a surface to be cleaned that is smaller than a contact area of floor cleaning unit 110 (referred to FIG. 10), knife-type brush 300 can be easily brought into contact with the recessed surface.

Figure 2:
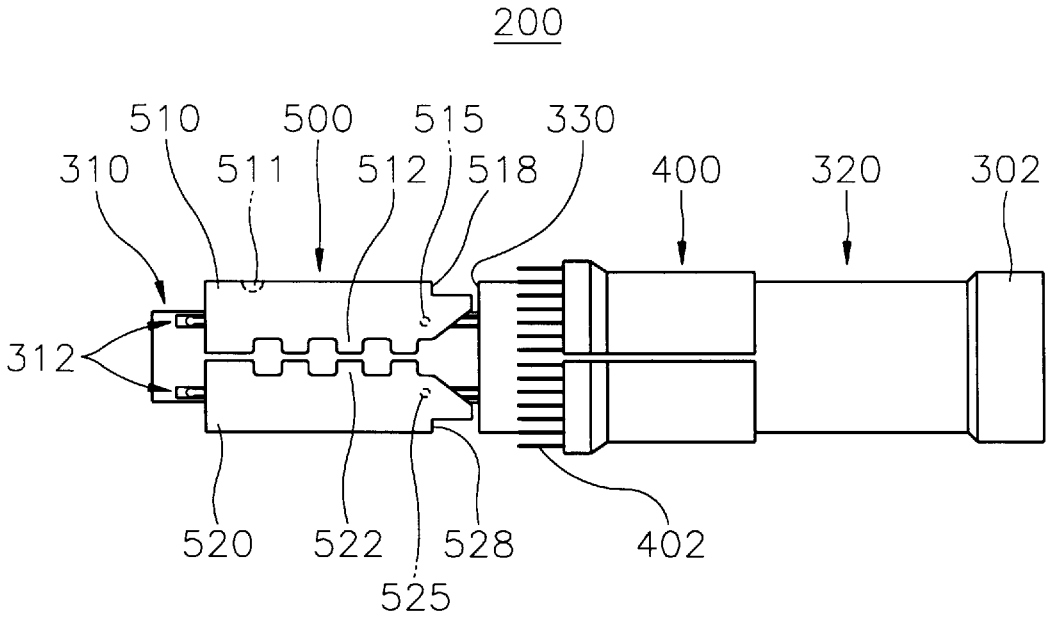
FIG. 2 illustrates an assembled state of the multipurpose auxiliary brush illustrated in FIG. 1.

As illustrated in FIGS. 2 and 3, knife-type brush 300 can be used under the state where haired brush 400 and carpet cleaning brush 500 are positioned on rear portion 320 and front portion 310 of knife-type brush 300, respectively. Haired brush 400 can be positioned on rear portion 320 by inserting first locking protrusion 404 of haired brush 400 into second locking groove 324 of rear portion 320. Further, carpet cleaning brush 500 can be positioned on front portion 310 by engaging second protrusion 513 and third protrusion 523 with first protrusion 312. Under this state, the user moves front portion 310 of knife-type brush 300 along the recessed surface. Thereby, dust or other foreign substances piled up on the recessed surface are sucked into the dust collecting compartment (not shown) of vacuum cleaner 100.

When a user of vacuum cleaner 100 cleans a recessed surface on which dust or other foreign substances has piled up such as a doorframe, a windowframe, or a corner of a room or a living room, by using multipurpose auxiliary brush 200, haired brush 400 is mainly employed. Because similar to knife-type brush 300, haired brush 400 has a contact area with a surface to be cleaned that is smaller than a contact area of floor cleaning unit 110, haired brush 400 can be easily brought into contact with the recessed surface, and haired brush 400 is adapted to sweep and clean dust or other foreign substances from the recessed surface to be cleaned.

Figure 6:
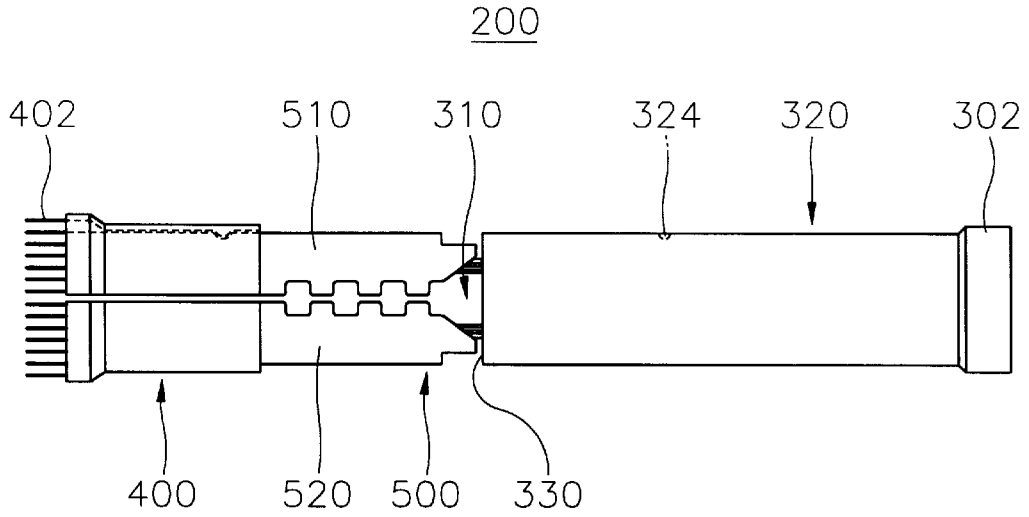
FIG. 6 illustrates an operation state of a haired brush illustrated in FIG. 1.

Haired brush 400 can be used under the state where haired brush 400 protrudes ahead of front portion 310 of knife-type brush 300, as illustrated in FIG. 6. For this purpose, the user of vacuum cleaner 100 manually pushes haired brush 400, which is mounted on rear portion 320 of knife-type brush 300, toward front portion 310. Then, first locking protrusion 404 is released from second locking groove 324 by the force applied by the user of vacuum cleaner 100. Thereby, haired brush 400 can be moved from rear portion 320 of knife-type brush 300 toward front portion 310 of knife-type brush 300.

When haired brush 400 is positioned on carpet cleaning brush 500, haired brush 400 is fixed on carpet cleaning brush 500 by inserting first locking protrusion 404 into third locking groove 511. Thereby, if haired brush 400 protrudes ahead of front portion 310 of knife-type brush 300, the user of vacuum cleaner 100 brings into contact haired brush 400 with the recessed surface to be cleaned. As a result, dust or other foreign substances piled up on the recessed surface are swept and sucked into the dust collecting compartment of vacuum cleaner 100.

Meanwhile, when a user of vacuum cleaner 100 cleans a variety of indented surfaces, in other words, non-flat surfaces such as a sofa, a carpet, or a foot board made of woven goods, carpet cleaning brush 500 is mainly employed. Since, carpet cleaning brush 500 is better adapted for beating and cleaning the indented surfaces than floor cleaning unit 110.

Figure 7:
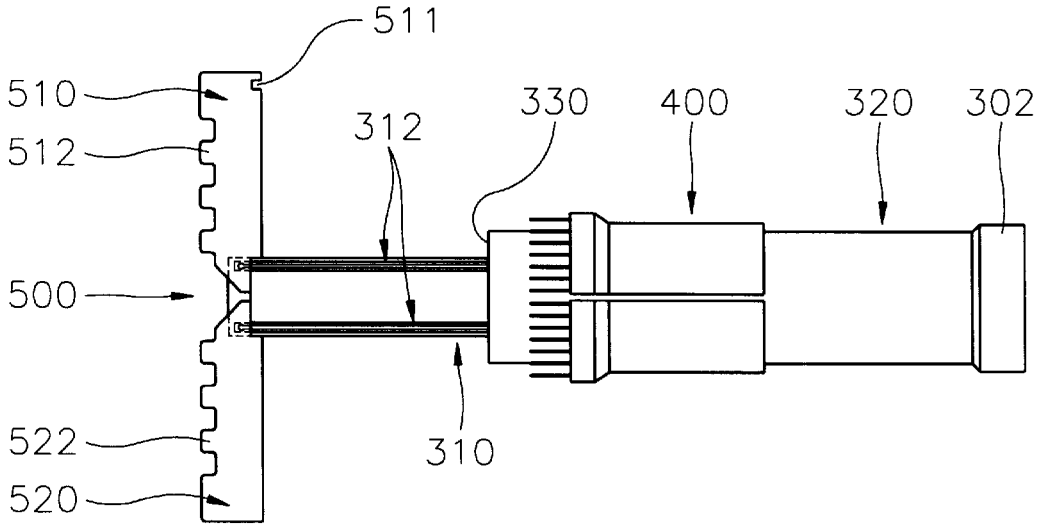
FIG. 7 illustrates an operation state of the carpet cleaning brush illustrated in FIG. 1.

Carpet cleaning brush 500 can be used under the state where carpet cleaning brush 500 protrudes ahead of front portion 310 of knife-type brush 300, as illustrated in FIG. 7. For this purpose, the user of vacuum cleaner 100 manually pushes carpet cleaning brush 500 toward front portion 310 during the state where haired brush 400 is mounted on rear portion 320 of knife-type brush 300. Then, first semi-circle shaped portion 510 and second semi-circle shaped portion 520 of carpet cleaning brush 500 slideably move in the forward direction along front portion 310 of knife-type brush 300 by a force applied by the user of vacuum cleaner 100. That is, second locking protrusion 515 and third locking protrusion 525, which are provided on first semi-circle shaped portion 510 and second semi-circle shaped portion 520 respectively, move along first guide slot 314 formed on first protrusion 312. As a result, carpet cleaning brush 500 can slide along front portion 310 of knife-type brush 300.

When second locking protrusion 515 and third locking protrusion 525 reach a first locking groove 316 formed on a front end of guide slot 314, first semi-circle shaped portion 510 and second semi-circle shaped portion 520 are symmetrically arranged in the vertical direction by the force applied by the user of vacuum cleaner 100. At this time, first semi-circle shaped portion 510 and second semi-circle shaped portion 520 are fixed in the upright state by tightly making contact with an outer surface of front portion 310 of knife-type brush 300. If first semi-circle shaped portion 510 and second semi-circle shaped portion 520 of carpet cleaning brush 500 are completely deployed, the user of vacuum cleaner 100 beats and cleans the indented surfaces such as a sofa, a carpet, or a foot board made of woven goods by using carpet cleaning brush 500. Thereafter, dust or other foreign substances released from the indented surfaces are sucked into the dust collecting compartment of vacuum cleaner 100.

Figure 8A:
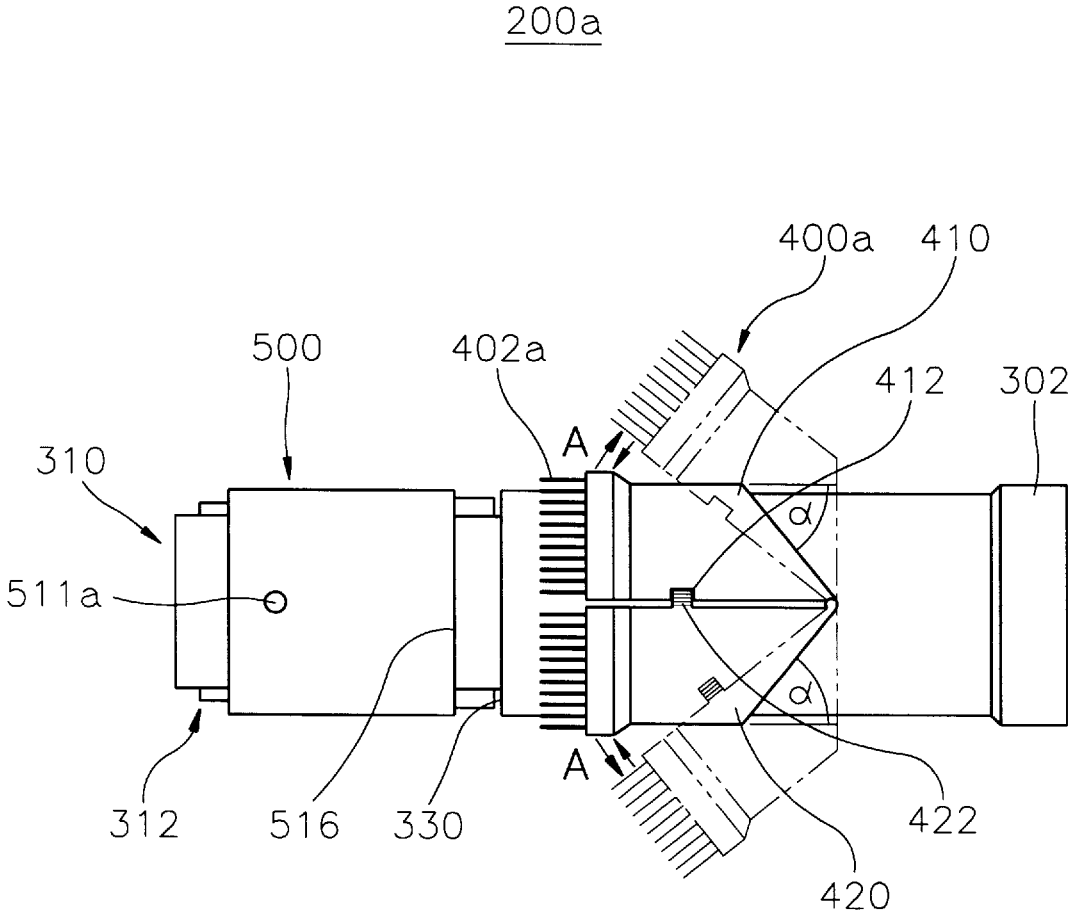
FIG. 8A is a perspective view of a multipurpose auxiliary brush according to a preferred second embodiment of the present invention.
Figure 8B:
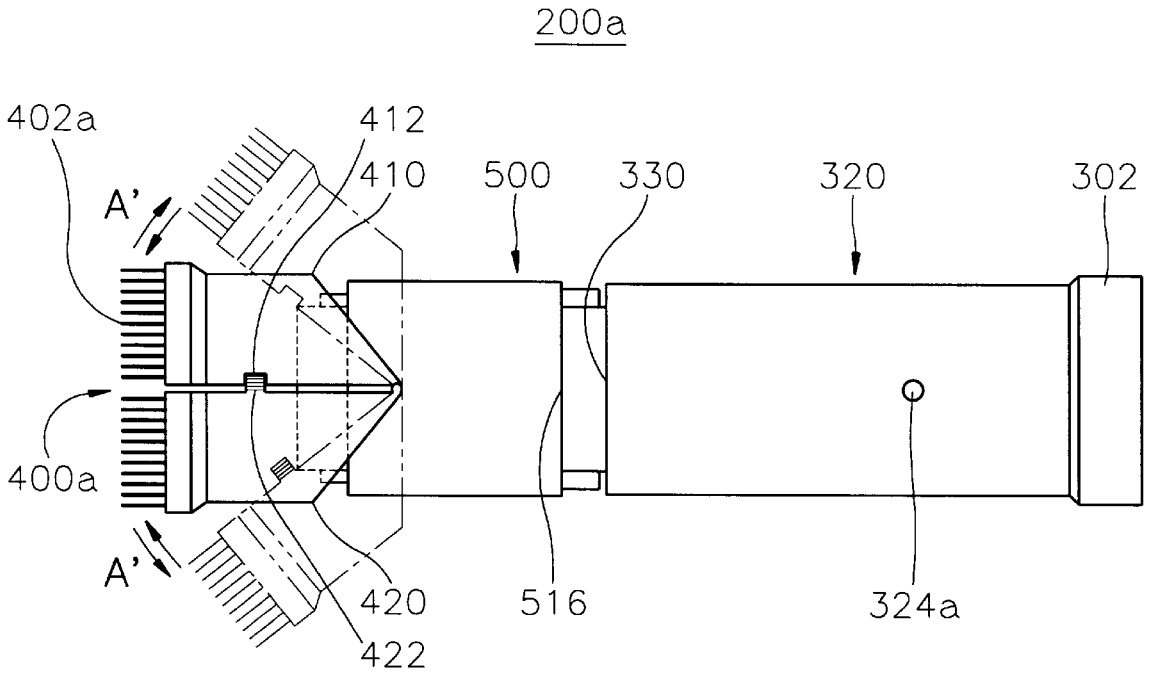
FIG. 8B illustrates an operation state of a haired brush illustrated in FIG. 8A.
Figure 8C:
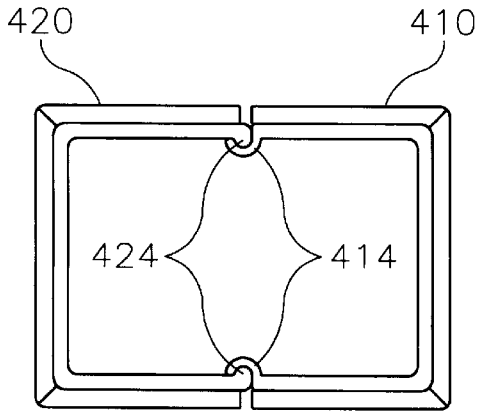
FIG. 8C is a right side elevational view of the haired brush illustrated in FIG. 8A.

Meanwhile, FIGS. 8A to 8C illustrate a multipurpose auxiliary brush 200*a* according to a preferred second embodiment of the present invention. Multipurpose auxiliary brush 200*a* has the same constitution as multipurpose auxiliary brush 200 according to the preferred first embodiment of the present invention, except that it has a haired brush 400*a*, a plurality of second locking grooves 324*a* for mounting haired brush 400*a* on rear portion 320 of knife-type brush 300, and a plurality of third locking grooves 511*a* for mounting haired brush 400*a* on carpet cleaning brush 500. Accordingly, descriptions of constitutional elements which are identical to the constitutional elements of multipurpose auxiliary brush 200 according to the preferred first embodiment of the present invention will be omitted. Further, inventive elements which are identical to the inventive elements used in the preferred first embodiment of the present invention have the same reference numerals.

Referring to FIG. 8A, haired brush 400*a* includes a semi-circle shaped first segment 410 and a semi-circle shaped second segment 420 which are separated from each other. A plurality of hairs 402*a* are attached to a front end of first segment 410 and a front end of second segment 420, respectively. A rear end of first segment 410 is cut off at a certain angle ($\propto$) in relation to an outer periphery of first segment 410. Similarly, a rear end of second segment 420 is cut off at a certain angle ($\propto$) in relation to an outer periphery of second segment 420. Thereby, when first segment 410 and second segment 420 are arranged in a fan shape as shown in FIGS. 8A and 8B, the outer surface of rear portion 320 and the outer surface of carpet cleaning brush 500 do not disturb the arranging of first segment 410 and second segment 420.

Meanwhile, a locking groove 412 is formed at a center of first segment 410. A locking protrusion 422 correspondent to locking groove 412 is formed at a center of second segment 420. First segment 410 and second segment 420 are tightly joined together by locking groove 412 and locking protrusion 422. It will be understood that locking groove 412 and locking protrusion 422 may be replaced by a plurality of locking grooves and locking protrusions.

Referring to FIG. 8C, a plurality of third locking protrusions 414 for mounting first segment 410 on rear portion 320 or for mounting first segment 410 on carpet cleaning brush 500 are formed at the rear end of first segment 410. Third locking protrusions 414 protrude from an inner surface of first segment 410 in the downward direction so that third locking protrusions 414 have a concave shape. A plurality of fourth locking protrusions 424 for mounting second segment 420 on rear portion 320 or for mounting second segment 420 on carpet cleaning brush 500 are formed at the rear end of second segment 420. Fourth locking protrusions 424 protrude from an inner surface of second segment 420 in the downward direction so that fourth locking protrusions 424 have a convex shape.

Multipurpose auxiliary brush 200*a* having the above described constitution operates in the same manner as multipurpose auxiliary brush 200 according to a preferred first embodiment of the present invention, except for an operation of haired brush 400*a*. Accordingly, hereinbelow the operation of multipurpose auxiliary brush 200*a* in relation to haired brush 400*a* will be described.

First, referring to FIG. 8A, haired brush 400*a* is mounted on rear portion 320 of knife-type brush 300 when a user of vacuum cleaner 100 mainly uses knife-type brush 300. That is, third locking protrusion 414 and fourth locking protrusion 424 are inserted into second locking groove 324*a*, and locking protrusion 422 of second segment 420 is inserted into locking groove 412 of first segment 410. Thereby, haired brush 400*a* is mounted on rear portion 320.

Under this state, when a user cleans a certain opening having a stage by mainly using knife-type brush 300, haired brush 400*a* can be arranged in a fan shape as indicated by arrows (A) in FIG. 8A. Therefore, the user of vacuum cleaner 100 can clean an interior of the opening by using knife-type brush 300 and can clean a part having the stage formed around the opening by using haired brush 400*a*.

When a user cleans an interior of an opening or cleans a recessed surface on which dust or other foreign substances has piled up such as a doorframe work, a windowframe, or a recessed place in a room, by mainly using haired brush 400*a*, haired brush 400*a* protrudes ahead of front portion 310 of knife-type brush 300 as shown in FIG. 8B. For this purpose, the user of vacuum cleaner 100 releases locking protrusion 422 from locking groove 412. Thereafter, the user of vacuum cleaner 100 releases third locking protrusion 414 and fourth locking protrusion 424 from second locking groove 324*a*.

Thereafter, haired brush 400*a* is mounted on carpet cleaning brush 500 in the same manner that haired brush 400*a* is mounted on rear portion 320 of knife-type brush 300. That is, third locking protrusion 414 and fourth locking protrusion 424 are inserted into third locking groove 511*a* formed on the outer periphery of carpet cleaning brush 500, and locking protrusion 422 of second segment 420 is inserted into locking groove 412 of first segment 410. Thereby, haired brush 400*a* is mounted on rear portion 320.

Thereby, if haired brush 400*a* protrudes ahead of front portion 310 of knife-type brush 300, haired brush 400*a* makes contact with the surface to be cleaned. As a result, dust or other foreign substances are swept from the surface to be cleaned and are sucked into the dust collecting compartment of vacuum cleaner 100. Further, as indicated by arrows (A') in FIG. 8B, after haired brush 400*a* is arranged in a fan shape, the user cleans the interior of the opening having a stage by using the fan shaped haired brush 400*a*.

Figure 9A:
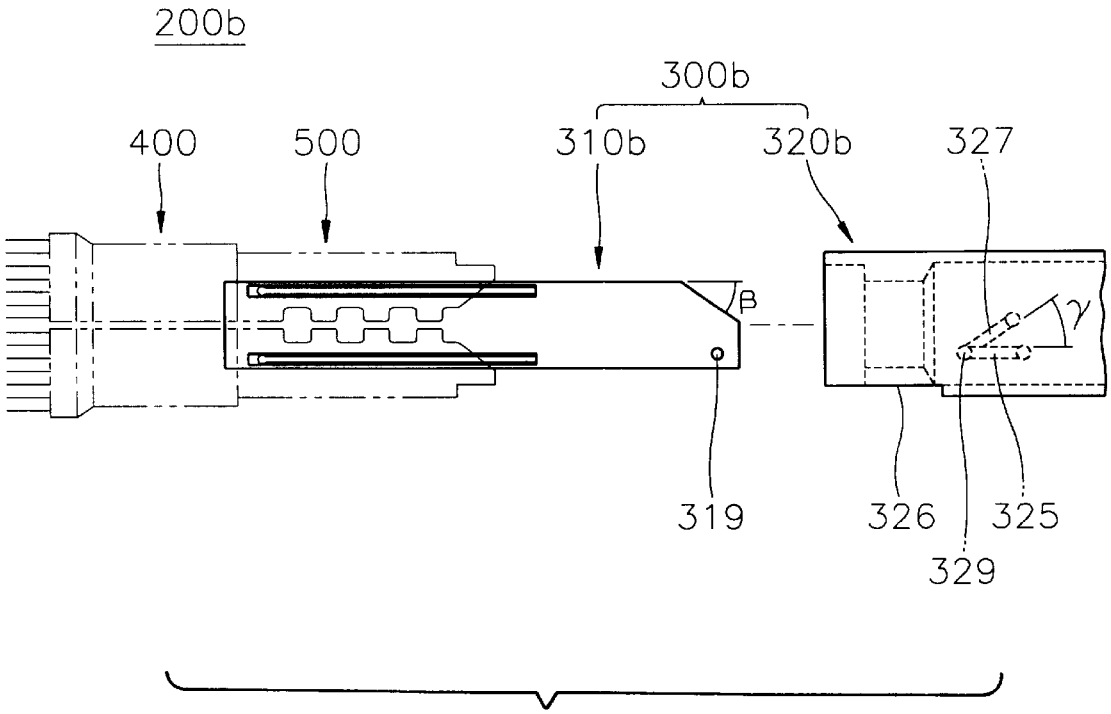
FIG. 9A is a partly exploded perspective view of a multipurpose auxiliary brush according to a preferred third embodiment of the present invention.
Figure 9B:
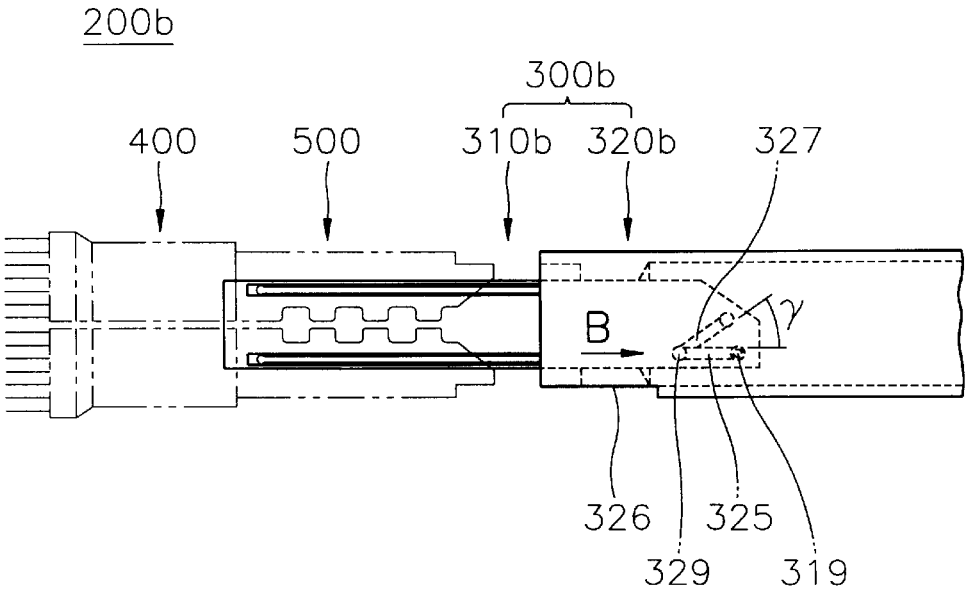
FIG. 9B illustrates an assembled state of a knife-type brush illustrated in FIG. 9A.
Figure 9C:
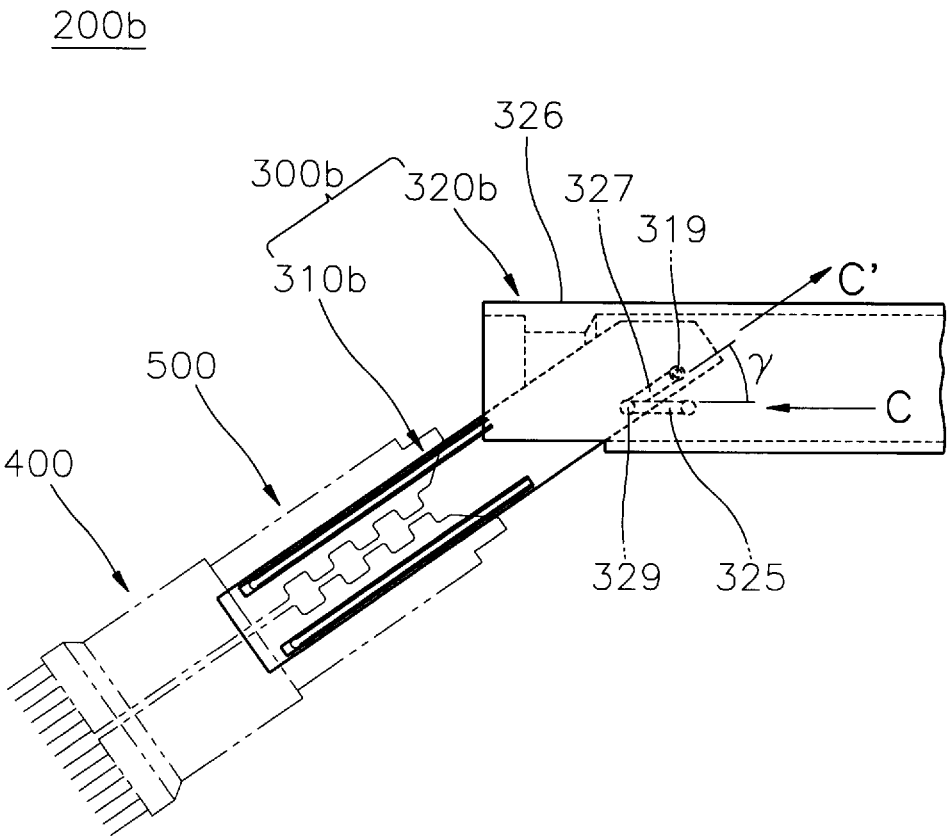
FIG. 9C illustrates an operation state of a knife-type brush illustrated in FIG. 9A.

FIGS. 9A to 9C illustrate a multipurpose auxiliary brush 200*b* according to a preferred third embodiment of the present invention. Multipurpose auxiliary brush 200*b* has the same constitution as multipurpose auxiliary brush 200 a according to a preferred first embodiment of the present invention, except that it has a knife-type brush 300*b*. Accordingly, descriptions of constitutional elements which are identical to the constitutional elements of multipurpose auxiliary brush 200 according to the preferred first embodiment of the present invention will be omitted. Further, inventive elements which are identical to the inventive elements used in the preferred first embodiment of the present invention have the same reference numerals.

Referring to FIG. 9A, knife-type brush 300*b* of multipurpose auxiliary brush 200*b* includes a front portion 310*b* and a rear portion 320*b*. A front portion 310*b* can be separated from rear portion 320*b*. An end of front portion 310*b* being inserted into rear portion 320*b* is cut off at a certain angle ($\beta$) in relation to an outer periphery of first segment 310*b*. At the cut-off end of front portion 310*b*, a fifth locking protrusion 319 protrudes in the outward direction.

A third cut-off portion 326 is formed at an end of rear portion 320*b*, into which front portion 310*b* is inserted. As indicated by the dotted line in FIG. 9A, a second guide slot 325 is formed in an inner periphery of rear portion 320*b* in a place adjacent to third cut-off portion 326. Second guide slot 325 is formed along a horizontal line on which fifth locking protrusion 319 is formed. Further, a third guide slot 327 is formed in the inner periphery of rear portion 320*b* in the place adjacent to second guide slot 325. Second guide slot 325 is connected to third guide slot 327 by a circular connecting groove 329. Second guide slot 325 is slanted to third guide slot 327 at a certain angle (γ).

Multipurpose auxiliary brush 200*b* having the above described constitution operates in the same manner as multipurpose auxiliary brush 200 according to a preferred first embodiment of the present invention, except for an operation of knife-type brush 300*b*. Accordingly, hereinbelow the operation of multipurpose auxiliary brush 200*b* in relation to knife-type brush 300*b* will be described.

Knife-type brush 300*b* according to the preferred third embodiment of the present invention is mainly used to clean a recessed surface such as a doorframe, a windowframe, or a corner of a room. Knife-type brush 300*b* is used under the state where front portion 310*b* and rear portion 320 are joined together by inserting front portion 310*b* into rear portion 320. That is, under the state before or after knife-type brush 300*b* is fitted onto rigid wand 132 of hose assembly 130, when front portion 310*b* is completely mounted in rear portion 320*b* as illustrated in FIG. 9B.

For this purpose, front portion 310*b* is inserted into rear portion 320*b* so that fifth locking protrusion 319 of front portion 310*b* is fitted into connecting groove 329 of rear portion 320*b*. Next, front portion 310*b* is completely inserted into rear portion 320*b* by sliding fifth locking protrusion 319 on second guide slot 325 along an arrow (C) direction. Then, the user brings into contact front portion 310 of knife-type brush 300*b* with the recessed surface to be cleaned and cleans dust or other foreign substances. As a result, dust or other foreign substances are sucked into the dust collecting compartment.

Meanwhile, in knife-type brush 300*b* according to the present invention, it is possible to change an angle of front portion 310*b* contacting the recessed surface to be cleaned. That is, it is possible to rotate front portion 310*b* from a combining position as shown in FIG. 9B to a pivot position as shown in FIG. 9C. For this purpose, the user moves front portion 310*b* while it is in the inner periphery of rear portion 320*b*.

In other words, the user moves front portion 310*b* on second guide slot 325 in the arrow (C) direction as shown in FIG. 9B. Then, after front portion 310*b* is positioned in connecting groove 329, the user positions front portion 310*b* on third guide slot 327 and moves it in an arrow direction (C'). At this time, front portion 310 protrudes through a third cut-off portion 326 formed on rear portion 320*b*. Thereby, front portion 310*b* is slanted in an angle (γ) which is established between first guide slot 325 and second guide slot 327.

As described above, the user slides front portion 310, which is capable of slanting in the angle (γ), along the recessed surface and cleans dust or other foreign substances. Thereafter, dust or other foreign substances released from the recessed surface are sucked into the dust collecting compartment of vacuum cleaner 100. As a result, it is possible to freely change the angle of knife-type brush 300*b* to make contact with the recessed surface, so the working realm of knife-type brush 300*b* is enlarged and the cleaning efficiency is highly enhanced.

Further, as indicated by the dotted line, when haired brush 400 mounted on front portion 310*b* of knife-type brush 300*b* is used or when carpet cleaning brush 500 mounted on front portion 310*b* of knife-type brush 300*b* is used, an angle between haired brush 400 and a surface to be cleaned or an angle between carpet cleaning brush 500 and a surface to be cleaned is freely changed. Accordingly, the working realm of haired brush 400 and carpet cleaning brush 500 are enlarged, and the cleaning efficiency is highly enhanced.

As described above, according to the preferred first embodiment of the present invention, it is possible to obtain multipurpose auxiliary brush 200 which is made up of knife-type brush 300, haired brush 400 and carpet cleaning brush 500. Accordingly, a user can perform various cleaning jobs by using a vacuum cleaner 100 having multipurpose auxiliary brush 200, regardless of an object and place to be cleaned.

Further, according to the preferred second embodiment of the present invention, it is possible to obtain multipurpose auxiliary brush 200*a* having an improved haired brush 400*a* in comparison to haired brush 400 of multipurpose auxiliary brush 200 according to the preferred first embodiment of the present invention. Accordingly, it is possible to easily clean an interior of an opening having a stage.

Further, according to the preferred third embodiment of the present invention, it is possible to obtain a multipurpose auxiliary brush 200*b* having an improved knife-type brush 300*b* in comparison to knife-type brush 300 of multipurpose auxiliary brush 200 according to the first preferred embodiment of the present invention. Accordingly, a working realm of a vacuum cleaner provided with multipurpose auxiliary brush 200*b* is enlarged, and the cleaning efficiency of the vacuum cleaner is enhanced. In addition, the vacuum cleaner offers convenience to the user.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. A multipurpose auxiliary brush for a vacuum cleaner, said multipurpose auxiliary brush comprising:

a first auxiliary brush for complementing a cleaning function of a main brush, said first auxiliary brush being adapted to clean a recessed surface and being mounted on a hose assembly of the vacuum cleaner through an end thereof, said first auxiliary brush including a front portion and a rear portion, in which said front portion has a first air flow passage formed through an interior of said front portion, and said rear portion has a second air flow passage formed through an interior of said rear portion;

a second auxiliary brush for complementing a cleaning function of a main brush, said second auxiliary brush being adapted to clean an indented surface of predetermined woven goods and being slideably mounted on said front portion, said second auxiliary brush including a first semi-circle shaped portion and a second semi-circle shaped portion which are separated from each other; and a third auxiliary brush for complementing a cleaning function of a main brush, said third auxiliary brush being adapted to clean a recessed surface and being slideably selectively mounted on said first auxiliary brush or said second auxiliary brush, said third auxiliary brush having a plurality of hairs attached to an end thereof.

2. A multipurpose auxiliary brush as claimed in claim 1, wherein said front portion includes a plurality of first protrusions for slideably supporting said second auxiliary brush, and said first protrusions are formed on an outer periphery of said front portion and extend in the longitudinal direction of said front portion.

3. A multipurpose auxiliary brush as claimed in claim 2, wherein first guide grooves for slideably guiding said second auxiliary brush are formed on upper portions of said first protrusions.

4. A multipurpose auxiliary brush as claimed in claim 3, wherein first locking grooves for stopping said second auxiliary brush from moving along said first guide grooves are formed on front ends of said first guide grooves.

5. A multipurpose auxiliary brush as claimed in claim 1, wherein a recess for receiving a part of said second auxiliary brush is formed in said rear portion.

6. A multipurpose auxiliary brush as claimed in claim 1, wherein said rear portion includes a second locking groove for fixing said third auxiliary brush on said rear portion when said third auxiliary brush is positioned on said rear portion, in which said second locking groove is formed on an outer periphery of said rear portion.

7. A multipurpose auxiliary brush as claimed in claim 1, wherein a diameter of said rear portion is larger than a diameter of said front portion, and a first shoulder is formed between said front portion and said rear portion.

8. A multipurpose auxiliary brush as claimed in claim 1, wherein said first air flow passage is pneumatically connected with said second air flow passage, and a diameter of said second air flow passage is larger than a diameter of said first air flow passage.

9. A multipurpose auxiliary brush as claimed in claim 1, wherein said first semi-circle shaped portion includes a third locking groove for fixing said third auxiliary brush on said second auxiliary brush when said third auxiliary brush is positioned on said second auxiliary brush, and said third locking groove is formed on an outer periphery of said first semi-circle shaped portion.

10. A multipurpose auxiliary brush as claimed in claim 1, wherein said first semi-circle shaped portion includes a plurality of first prominences and depressions formed at an inner lower portion of said first semi-circle shaped portion, and includes a plurality of first taper portions formed at an end of said first semi-circle shaped portion, and said second semi-circle shaped portion includes a plurality of second prominences and depressions formed at an inner lower portion of said second semi-circle shaped portion, and includes a plurality of second taper portions formed at an end of said second semi-circle shaped portion.

11. A multipurpose auxiliary brush as claimed in claim 10, wherein a first cut-off portion is formed between said first taper portions, and a second cut-off portion is formed between said second taper portions.

12. A multipurpose auxiliary brush as claimed in claim 10, wherein a second shoulder is formed at a lower portion of said first taper portion, and a third shoulder is formed at a lower portion of said second taper portion.

13. A multipurpose auxiliary brush as claimed in claim 1, wherein said first semi-circle shaped portion includes a plurality of second protrusions formed on an inner periphery of said first semi-circle shaped portion and extending in the longitudinal direction of said first semi-circle shaped portion, and includes a plurality of second locking protrusions formed on an inner periphery of said first taper portion and protruding in the inward direction, and said second semi-circle shaped portion includes a plurality of third protrusions formed on an inner periphery of said second semi-circle shaped portion and extending in the longitudinal direction of said second semi-circle shaped portion, and includes a plurality of third locking protrusions formed on an inner periphery of said second taper portion and protruding in the inward direction.

14. A multipurpose auxiliary brush as claimed in claim 1, wherein said third auxiliary brush includes a first locking protrusion formed on an inner periphery of said third auxiliary brush and extending in the inward direction, said first locking protrusion is inserted into said second locking groove when said third auxiliary brush is slideably positioned on said first auxiliary brush, and said first locking protrusion is inserted into said third locking groove when said third auxiliary brush is slideably positioned on said second auxiliary brush.

15. A multipurpose auxiliary brush as claimed in claim 1, wherein said third auxiliary brush has a cylindrical-shape, and one side of said third auxiliary brush is cut off.

16. A multipurpose auxiliary brush as claimed in claim 1, wherein said third auxiliary brush includes a first segment and a second segment which are separated from each other, and an end of said first segment and an end of said second segment are cut off at a predetermined first angle with reference to an outer periphery of said third auxiliary brush.

17. A multipurpose auxiliary brush as claimed in claim 16, wherein said first segment includes a concave third locking protrusion formed at an end of said first segment and protruding in the inward direction, and said second segment includes a convex fourth locking protrusion formed at an end of said second segment and protruding in the inward direction.

18. A multipurpose auxiliary brush as claimed in claim 17, wherein said third locking protrusion and said fourth locking protrusion are inserted into said second locking groove when said third auxiliary brush is slideably positioned on said first auxiliary brush, and said third locking protrusion and said fourth locking protrusion are inserted into said third locking groove when said third auxiliary brush is slideably positioned on said second auxiliary brush.

19. A multipurpose auxiliary brush as claimed in claim 16, wherein said first segment includes a locking groove formed at a center of said first segment, and said second segment includes a locking protrusion formed at a lower center of said second segment.

20. A multipurpose auxiliary brush as claimed in claim 19, wherein said locking protrusion is inserted into said locking groove when said third auxiliary brush is slideably positioned in a selected position on said first auxiliary brush or said second auxiliary brush.

21. A multipurpose auxiliary brush as claimed in claim 1, wherein said front portion and said rear portion are separately formed, an end of said front portion which is capable of being inserted into said rear portion is cut off at a predetermined second angle, and a third cut-off portion is formed at a front end of said rear portion.

22. A multipurpose auxiliary brush as claimed in claim 21, wherein said front portion includes a fifth locking protrusion formed on an outer periphery of the end of said front portion and protruding in the outward direction, and said rear portion includes a second guide slot formed along a horizontal line on which said fifth locking protrusion is formed, a third guide slot formed in a predetermined third angle to said second guide slot, and a connecting groove for connecting said second guide slot with said third guide slot.

23. A multipurpose auxiliary brush for a vacuum cleaner, said multipurpose auxiliary brush comprising:

(a) a first auxiliary brush for complementing a cleaning function of a main brush, said first auxiliary brush being adapted to clean a recessed surface and being mounted on a hose assembly of the vacuum cleaner through an end thereof, said first auxiliary brush including a front portion and a rear portion, in which said front portion includes a first air flow passage formed through an interior of said front portion and includes a plurality of first protrusions formed on an outer periphery of said front portion and extending in the longitudinal direction of said front portion, and first guide grooves are formed on upper portions of said first protrusions, and first locking grooves are formed on front ends of said first guide grooves, and a recess is formed in said rear portion, and said rear portion includes a second air flow passage formed through an interior of said rear portion and includes a second locking groove formed on an outer periphery of said rear portion, and a diameter of said rear portion is larger than a diameter of said front portion, and a first shoulder is formed between said front portion and said rear portion, said first air flow passage is pneumatically connected with said second air flow passage, and a diameter of said second air flow passage is larger than a diameter of said first air flow passage;

(b) a second auxiliary brush for complementing a cleaning function of a main brush, said second auxiliary brush being adapted to clean an indented surface of predetermined woven goods and being slideably mounted on said front portion, said second auxiliary brush including a first semi-circle shaped portion and a second semi-circle shaped portion which are separated from each other, in which said first semi-circle shaped portion includes a third locking groove formed on an outer periphery of said first semi-circle shaped portion, and includes a plurality of first prominences and depressions formed at an inner lower portion of said first semi-circle shaped portion, and includes a plurality of first taper portions formed at an end of said first semi-circle shaped portion, and said second semi-circle shaped portion includes a plurality of second prominences and depressions formed at an inner lower portion of said second semi-circle shaped portion, and includes a plurality of second taper portions formed at an end of said second semi-circle shaped portion, and a first cut-off portion is formed between said first taper portions, and a second cut-off portion is formed between said second taper portions, and a second shoulder is formed at a lower portion of said first taper portion, and a third shoulder is formed at a lower portion of said second taper portion, and said first semi-circle shaped portion includes a plurality of second protrusions formed on an inner periphery of said first semi-circle shaped portion and extending in the longitudinal direction of said first semi-circle shaped portion, and includes a plurality of second locking protrusions formed on an inner periphery of said first taper portion and protruding in the inward direction, and said second semi-circle shaped portion includes a plurality of third protrusions formed on an inner periphery of said second semi-circle shaped portion and extending in the longitudinal direction of said second semi-circle shaped portion, and includes a plurality of third locking protrusions formed on an inner periphery of said second taper portion and protruding in the inward direction; and (c) a third auxiliary brush for complementing a cleaning function of a main brush, said third auxiliary brush being adapted to clean a recessed surface and being slideably selectively mounted on said first auxiliary brush or said second auxiliary brush, said third auxiliary brush including a plurality of hairs attached to an end thereof, and including a first locking protrusion formed on an inner periphery of said third auxiliary brush and extending in the inward direction, in which said first locking protrusion is inserted into said second locking groove when said third auxiliary brush is slideably positioned on said first auxiliary brush, and said first locking protrusion is inserted into said third locking groove when said third auxiliary brush is slideably positioned on said second auxiliary brush.

24. A multipurpose auxiliary brush as claimed in claim 23, wherein said third auxiliary brush has a cylindrical-shape, and one side of said third auxiliary brush is cut off.

25. A multipurpose auxiliary brush as claimed in claim 23, wherein said third auxiliary brush includes a first segment and a second segment which are separated from each other, and an end of said first segment and an end of said second segment are cut off at a predetermined first angle with reference to an outer periphery of said third auxiliary brush.

26. A multipurpose auxiliary brush as claimed in claim 25, wherein said first segment includes a concave third locking protrusion formed at an end of said first segment and protruding in the inward direction, and said second segment includes a convex fourth locking protrusion formed at an end of said second segment and protruding in the inward direction.

27. A multipurpose auxiliary brush as claimed in claim 26, wherein said third locking protrusion and said fourth locking protrusion are inserted into said second locking groove when said third auxiliary brush is slideably positioned on said first auxiliary brush, and said third locking protrusion and said fourth locking protrusion are inserted into said third locking groove when said third auxiliary brush is slideably positioned on said second auxiliary brush.

28. A multipurpose auxiliary brush as claimed in claim 25, wherein said first segment includes a locking groove formed at a center of said first segment, and said second segment includes a locking protrusion formed at a lower center of said second segment, said locking protrusion is inserted into said locking groove when said third auxiliary brush is slideably positioned in a selected position on said first auxiliary brush or said second auxiliary brush.

29. A multipurpose auxiliary brush as claimed in claim 23, wherein said front portion and said rear portion are separately formed, an end of said front portion which is capable of being inserted into said rear portion is cut off at a predetermined second angle, and a third cut-off portion is formed at a front end of said rear portion.

30. A multipurpose auxiliary brush as claimed in claim 29, wherein said front portion includes a fifth locking protrusion formed on an outer periphery of the end of said front portion and protruding in the outward direction, and said rear portion includes a second guide slot formed along a horizontal line on which said fifth locking protrusion is formed, a third guide slot formed in a predetermined third angle to said second guide slot, and a connecting groove for connecting said second guide slot with said third guide slot.

* * * * *